US007318882B2

(12) United States Patent
Niemi

(10) Patent No.: US 7,318,882 B2
(45) Date of Patent: Jan. 15, 2008

(54) METHOD AND APPARATUS FOR MONITORING OF THE DRY LINE IN A FOUDRINIER PAPER MACHINE AND FOR CONTROL BASED THEREUPON

(76) Inventor: Antti Niemi, Yrjoe Liipolan tie 5, FI-02700 Kauniainen (FI)

( * ) Notice: Subject to any disclaimer, the term of this patent is extended or adjusted under 35 U.S.C. 154(b) by 449 days.

(21) Appl. No.: 10/513,733

(22) PCT Filed: May 9, 2003

(86) PCT No.: PCT/FI03/00361

§ 371 (c)(1),
(2), (4) Date: Nov. 4, 2004

(87) PCT Pub. No.: WO03/095739

PCT Pub. Date: Nov. 20, 2003

(65) Prior Publication Data

US 2005/0139339 A1 Jun. 30, 2005

(30) Foreign Application Priority Data

May 10, 2002 (FI) ..... 20020890

(51) Int. Cl.
*D21F 7/06* (2006.01)
*D21F 11/00* (2006.01)

(52) U.S. Cl. ..... 162/198; 162/259; 162/262; 162/263; 162/DIG. 10

(58) Field of Classification Search ..... 162/198, 162/263, 252, 253, 256, 259, 262, DIG. 6, 162/DIG. 10, DIG. 11; 348/88; 250/339.1; 700/128, 129; 356/429–431; 250/559.16, 250/559.18
See application file for complete search history.

(56) References Cited

U.S. PATENT DOCUMENTS 4,500,968 A * 2/1985 Bialkowski ..... 700/128

(Continued)

FOREIGN PATENT DOCUMENTS

CA 10114638 7/1977

(Continued)

OTHER PUBLICATIONS

Proceedings of Control System 2002 Conference, Stockholm, Jun. 3-5, 2002, pp. 308-312.

(Continued)

*Primary Examiner*—Eric Hug
(74) *Attorney, Agent, or Firm*—Jordan and Hamburg LLP

(57) ABSTRACT

In order to observe the dry line formed on the surface of wood fibre pulp on the moving wire in a Fourdrinier paper machine, its—atrea of appearance is scanned at a low angle with a thin beam cluster (A1, B1) which, being generated by a laser radiation source (20) and representing one or more discrete wavelengths, is distinguishable from the background light. Hereby the surface following the dry line (I) reflects diffusively a major part and specularly a minor part of the arriving radiation than the surface preceding it. A detector (30) located above the level of the wire observes the intensity of the diffusely reflected radiation (A3, B3) hitting it and delivers continuously, as the beam cluster scans the pulp surface, a signal which is proportional to said intensity. The signal is digitized repeatedly and processed in real time in a computer, whereby a series of signals in the direction of the paper machine produces one dry line point and, if repeated for different positions in the cross direction, the dry line consisting of such points. The dry line and the values of quantities and deviations characterizing it are displayed by graphical and numerical terminals and actuators of the paper machine are controlled according to it automatically, synchronously with the scanning of the dry line region. The method can be implemented also in such paper machine environments, to which the earlier methods for structural reasons do not apply.

8 Claims, 2 Drawing Sheets

U.S. PATENT DOCUMENTS

| | | | | | |
|---|---|---|---|---|---|
| 5,011,573 | A | | 4/1991 | Niemi | |
| 5,472,571 | A | * | 12/1995 | Niemi | 162/198 |
| 5,492,601 | A | * | 2/1996 | Ostermayer et al. | 162/198 |
| H001616 | H | * | 12/1996 | Wolfe | 348/88 |
| 6,053,040 | A | * | 4/2000 | Callender et al. | 73/159 |

FOREIGN PATENT DOCUMENTS

| | | |
|---|---|---|
| FI | 751094 | 10/1975 |
| FI | 75887 | 12/1986 |
| WO | 88/05099 | 7/1988 |
| WO | 92/20861 | 11/1992 |

OTHER PUBLICATIONS

Cover page of book "Laser Beam Scanning", Marcel Dekker, Inc. 1985.

J. Berndtson, A.J. Niemi & S. Karine, In Proceedings of 27th Eucepa Conf., Grenoblé, Oct. 1999.

* cited by examiner

METHOD AND APPARATUS FOR MONITORING OF THE DRY LINE IN A FOUDRINIER PAPER MACHINE AND FOR CONTROL BASED THEREUPON

BACKGROUND OF THE INVENTION

The subject of the present invention is a method for determining the dry line in a paper machine. The invention relates correspondingly to an apparatus for carrying out this method.

SUMMARY OF THE INVENTION

In order to reach a final product of even quality at the papermaking, it is important that properties of the pulp web are measured and controlled already at the wet end of the paper machine, where the most important actuators affecting the web formation and thus the quality of the paper or board are located. By these means one avoids the delay which is characteristic to the conventional control based on measurements made at the dry end.

An essential part of the wet end of a Fourdrinier paper machine is the continuously moving plane wire, on which the dilute wood fibre pulp is fed and on which it settles forming a web. A major part of the water contained in the fibre pulp is removed through the holes of the wire. An essentially transversal, meandering dry line or several dry lines, which relate to the removal of water from the pulp, appear on the surface of the web. The observation and exploitation of just this dry line is essential to the present invention.

As the water or actually the dilute water solution behaving like water is decreased in and removed from the surface layer of the pulp the reflectance of the surface is changed. A typical dry line exhibits the disappearance of the specularly reflecting water from the pulp surface and the dimming of the pulp surface at a transfer to the later side of this place. The change can, at some places, be observed even by naked eye, primarily when a suitably located observer sees the mirror image of the light source only as a partial figure cut by the dry line. The machine operators accordingly base their numerous, manual control actions traditionally on their partial and subjective dry line observations of this kind.

Instrumental methods have been developed earlier, for formation of an image of the dry line, for the whole extent of the latter. Their practical operation requires i.a. that the area of its appearance is illuminated as homogeneously as possible. An optical image of the total area of appearance of the dry line can thereby be formed by a video camera on its detector surface. By transferring the electrical image signal to a digital computer one may further analyze the image and determine the dry line by means of a program serving this aim. The dry line determined by such means can be reproduced by a graphical monitor display or by a printed output and expressed also as a data sequence or by means of average and other characteristic numbers. The dry line data can further be transferred to a controller, which may be a program block programmed to act as a controller or a separate device unit, and which controls by feedback an actuator affecting the dry line, such as the lip or lip screws of the head box; or in a feedforward manner actuators existing at a later part of the paper machine.

One method and apparatus according to the preceding description, for determination of the dry line and for control based on it has been presented e.g. in the EP patent No 341248. They are based on illumination of the wire in such a manner that, at a transfer in the direction of the pulp transport, the dry line appears in the image formed as a transition from a dark surface of a breadth of the web to a light surface. Correspondingly, the method and apparatus according to the EP patent No 586458, for reaching of the same result, are based on illumination of the wire in such a manner that the dry line appears as a transition from a light surface to a dark one.

The customary dry line manifests, if expressed by means of properties of the pulp surface, a decrease of the specular reflectivity and an increase of the diffuse reflectivity of the surface, of which the former method (EP 341248) stresses the latter feature and the later one (EP 586458) the former feature. A detailed report on the use of the stated methods has been published during the priority year (in Proceedings of Control Systems 2002 Conference, Stockholm, Jun. 3-5, 2002, pages 308-312, A. J. Niemi & S. Karine), and in related reference publications. It also appears from the stated paper that two different dry lines may typically and simultaneously appear on one wire.

The methods described above cannot, however, be implemented in all paper machines, whenever the structures of the machine itself or of its environment prohibit the specified illumination or observation, which need space at both sides of the machine. Even if implemented, the systems of the described types may hamper the maintenance of the machine, such as the change of the wire cloth, taking place at regular intervals. They also lose a major part of the electrical power consumed by the continuous illumination, because the on-line image analysis according to them is based on a series of individual images, whereby the power used for illumination during their intervals, which depend on the analysis program is wasted. Because the stated methods use, for production of the dry line signal, light of a wide spectrum which does not differ much from the spectrum of the general illumination at the place of their use, the light used for detection of the dry line must be relatively powerful, in order to produce a sufficient signal-to-background ratio.

The subject of the present invention is a method for determining the dry line in a paper machine. The invention relates correspondingly to an apparatus for carrying out this method.

An object of the invention is to create a solution, which produces, a primary measurement signal which differs from the background better than those produced by the earlier methods, and through it, detection of the dry line and control signal of the paper machine at an essentially lower electrical power than that needed by them. An object is also to present a solution which can be implemented in many such paper machine environments as well, in which the earlier methods are not applicable for structural reasons.

The invention will be explained in the following more closely, by means of examples and referring to the attached drawings.

Figure 1:
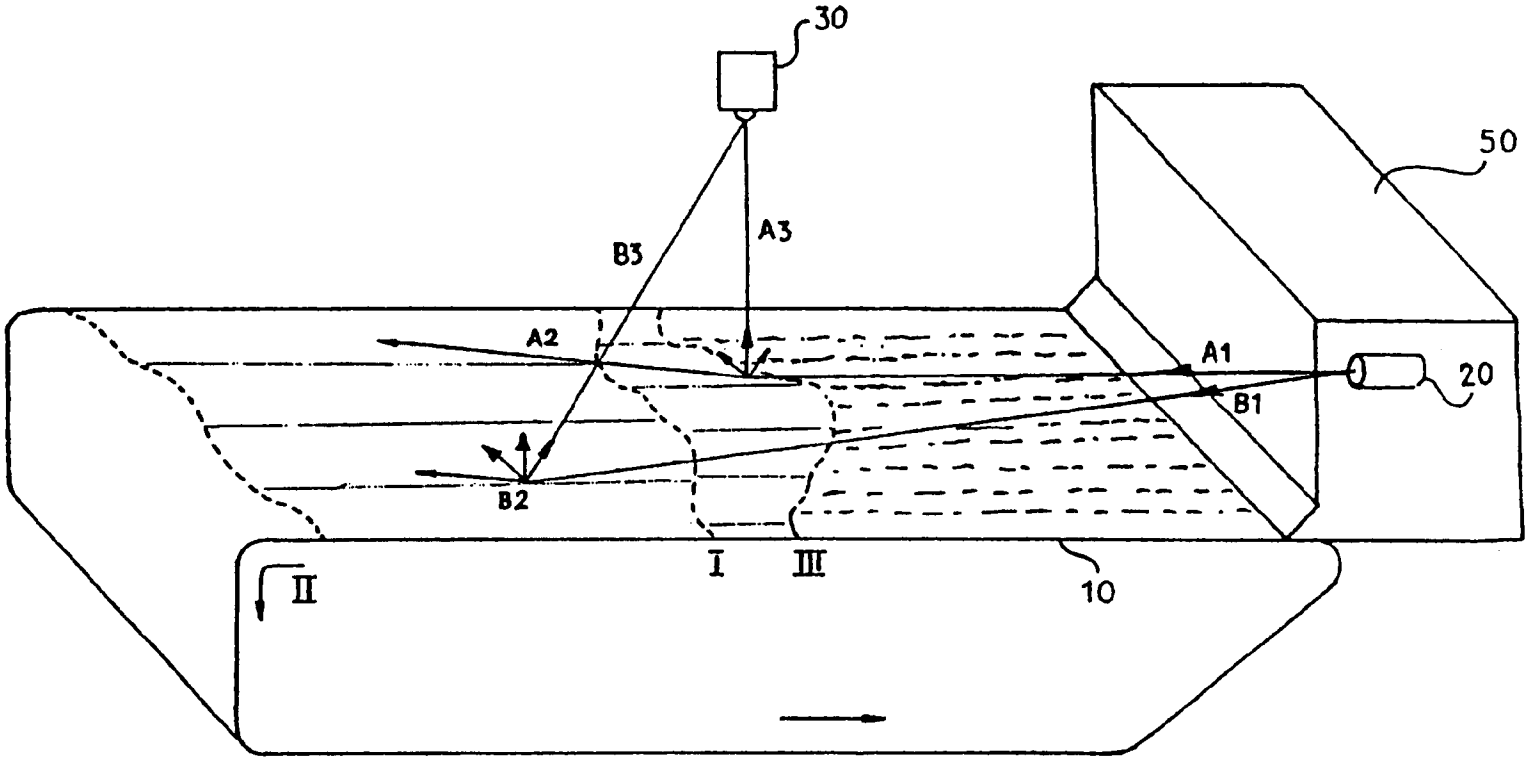
FIG. 1 presents the equipment aimed at the implementation of the method according to the invention.

DESCRIPTION OF THE PREFERRED EMBODIMENTS:

FIG. 1 presents the paper machine's wire part 10, on which the turbulent surface of the pulp coming from the head box 50 calms down, at the border III, to a plane, specularly reflecting water surface. At the dry line I the specular reflectance of the surface is decreased and its scattering reflectance increased. A similar phenomenon appears further at the dry line II situated at the flat suction box. The radiation source 20 emits a scanning laser beam A1 which, if hitting the specularly reflecting surface produces the specularly reflected ray A2. If in turn hitting the part after the dry line, the scanning laser beam B1 produces a weaker, specularly reflected ray B2. The detector 30 detects the rays A3 and B3 reflected diffusely by the points of hit.

Figure 2:
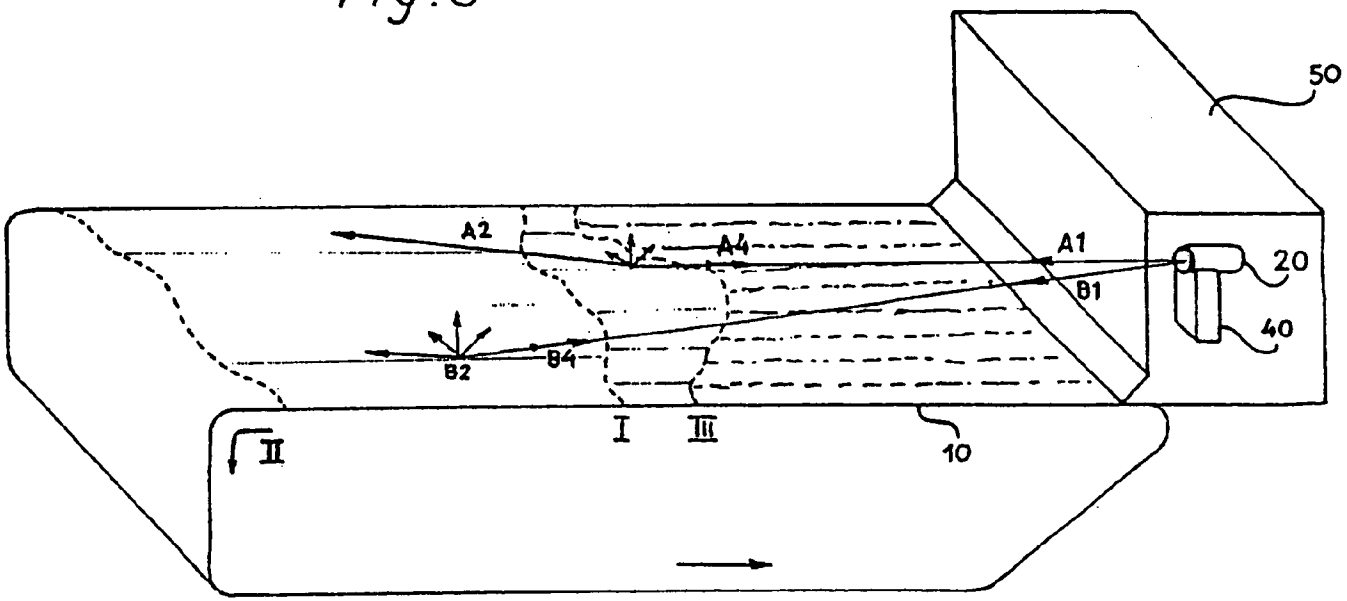
FIG. 2 presents an alternative geometry of the equipment.

The alternative structure according to FIG. 2 differs from FIG. 1 only in that the detector 40 is located at or next to the radiation source 20. The diffuse reflections or the rays hitting the detector are marked by A4, correspondingly by B4.

The new invention for production of a dry line signal is based on the use of a light source emitting electromagnetic radiation of a narrow wavelength range or more such radiation components simultaneously, whereby a high signal/background ratio is reached-with regard to the background radiation of a wide spectrum. Radiation of this kind is produced in practice by using a strongly directing source of laser radiation. The radiation emitted by such a source represents typically one wavelength or a narrow wavelength range or a few, separate wavelengths only. Said wavelength may lie in the visible or invisible part of the spectrum. The HeNe laser emitting red light of the wavelength 633 nm is an appropriate example of a radiation source which suits to many types of pulps. The commercially available laser radiation sources have usually been constructed for emission of unidirectional radiation of a thin cross section.

A light source of solid state, such as a laser, is stated preferable at measurement of the roughness of a product's surface at the dry end of the paper machine by the method according to the Canadian patent No 1014638. The source and the detector of reflected, scattered light are permanently located in a measurement head which may be a fixed one or moving in the transversal direction of the machine, and which is close to the web surface and in contact to this. However, this method does not include the distribution of illumination onto a wide, two-dimensional material surface, which would be required by detection of the meandering dry line extending from one side of the pulp to the other side. It is obviously also impossible to bring the device according to the method into contact with pulp in the wet end of the paper machine, and also to locate it into proximity of the humid pulp surface, because of e.g. the condensing humidity evaporated from the pulp.

Laser is used as the preferable light source in determination of the fibre orientation in the dry end of the paper machine by the method according to the U.S. Pat. No. 5,640,244. The light radiation is thereby pointed in a fixed direction to the surface of the paper, while each radiation source and detector either are permanently installed or traverse together mechanically, in the cross direction of the machine, said determination being based on detection of the reflectively scattered light and usually also on that of light scattered back to different directions, i.e. diffusively. This method does neither comprise a distribution of illumination onto a two-dimensional material surface, nor has its use to other monitoring of the humid fibre pulp in the wet end of the paper machine been disclosed.

Laser radiation obeys the general laws of physical optics. As it hits e.g. the diffusely reflecting pulp surface at the far side of the stated, typical dry line I, it is scattered from it to the space above the wire, especially to the direction of the specular reflexion and directions close to this, but diffusely also to all other directions. From all directions above the wire, the point hit is seen as a spot, which is considerably brighter than its environment. If the beam hits, instead of that, the specularly reflecting water surface preceding the dry line, a part of it determined by the angle of arrival is reflected into direction of the principal reflection, and the other part refracted below the water surface. The latter part is absorbed under water by fibres and by the settling fibre mass, or scattered by them and after scattering brought back to pulp by total reflection at the water surface, or returned above it after refraction at the surface. Because of the last component stated, the primary point hit and its near environment can be discerned also from other directions above the surface than that of the principal reflection, but due to the reflection and absorption being considerably weaker than a point hit at the far side of the dry line. The discernible difference of intensities is the greater, the smaller the angle of arrival of the primary ray and its generation is analogous to the difference generated by the use of directed customary light, which has been discussed more widely in the EP patent No 341248 stated previously.

The dry line, which indicates the disappearance of free water from the pulp surface, can thus be determined by pointing a laser beam in a low angle to the pulp surface both before and after the dry line, or by scanning the pulp with a laser beam in machine direction and measuring the intensities of the radiation scattered to a separate detector from different points hit. A pass-over from a weak, scattered signal to a strong signal indicates thereby the location of a single dry line point, which may be defined more closely as the location of e.g. the average value of the readings before and after the dry line, or as that of their steepest change or as that according to other suitable criterion.

A change of reflectance in the same direction as that at the dry line I appears again at the dry line II located in the range of the flat suction box. Because of the strong suction by the flat suction box, an essential part of the water left between the fibres is removed here from the pulp on the wire, whereby the reflectively scattered radiation is further decreased and the diffusively scattered radiation increased. The increase of intensity of the diffusively scattered radiation and the dry line II corresponding to that can therefore be measured and determined essentially in the same manner as that presented previously about the determination of the dry line I.

Figure 3:
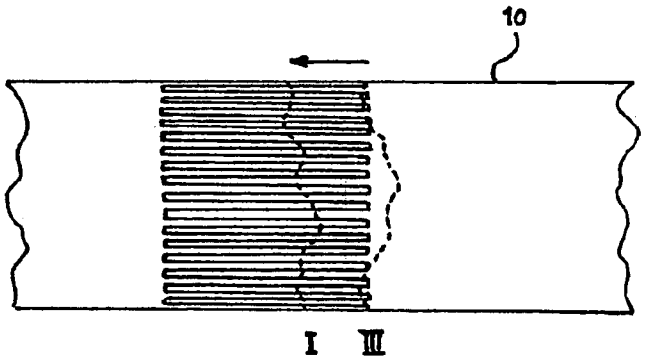
FIG. 3 presents schematically a laser beam scanning the wire.

In order to detect the form or average location of the dry line, a sufficient amount of dry line points has to be sought for over the whole breadth of the wire, by extending the laser scanning and analysis of the measured data to the whole, two-dimensional area of appearance of the dry line. FIG. 3 presents, by way of an example, the manner in which the laser beam scans the area of appearance of the dry line I, in both longitudinal and crosswise direction.

E.g. turning or rotating mirrors, such as the galvanometer scanner provided with two, turning mirrors to which the laser beam is directed, can be used to control the laser beam according to the manner described. Measured data which is proportional to the scatter is obtained on the points in the area of appearance of the dry line, which are known by means of the known dependencies of the directional angle on voltage and of the known galvanometer/wire geometry, by changing stepwise the control voltages of the mirrors.

The data may be interpolated into a rectangular coordinate system according to the main directions of the machine, for a computational determination of the dry line and of quantities descriptive of it. Alternatively, by adjusting the control voltages of the mirrors in such a manner that the hits of the beam on the pulp surface form a rectangular network according to the main directions of the machine, the stated quantities can be determined in a straightforward manner. As such, the laser scanning similarly as the detection of the radiation scattered by its target represent prior art, which is described e.g. in the book "Laser Beam Scanning", Marcel Dekker, Inc. 1985, edited by G. F. Marshall; the book includes also examples of laser scanners produced industrially.

A suitable location of the laser radiation source 20 is above the centre line of the wire, in such a place, from which the laser beam can be pointed to all parts of the area of appearance of the dry line, in a low angle. However, the source can be located also elsewhere above the level of wire and outside the wire, assuming that the conditions stated in the previous sentence are satisfied.

The sensor for measurement of radiation scattered by the target may be a photo diode, photo multiplier or other optoelectrical detector, which is sensitive to said radiation. Lens hoods, optics of high lighting capacity and optical filters can also be used, for an added distinction of the signal being measured. The detector may be located in a fixed or rotating manner in such a place (see 30, FIG. 1) where the light from all points of the dry line area can reach it. Because the scattered or diffusely reflected radiation is often powerful in directions next to the specularly reflected radiation, it is generally favourable that the direction of measurement of the scattered radiation differs clearly from the direction of the specular reflection. The choice of the type and power of the laser and that of the sensitivity of the detector is influenced also by i.a. the weakening of the secondary radiation between the wire and detector, while the thin primary beam may be considered to reach all parts of the dry line area with a practically equal power.

It is quite useful to fix this detector 40 to the radiation source, similarly as presented in FIG. 2, in such a manner that the scattered radiation arriving from the target always hits it; practices for separation of the returning backscattered radiation from the primary rays have been described in the source stated above (G. F. Marshall).

The stated source (G. F. Marshall) contains also information, which deals with reading of information from the object, such as reading of pictures and writings from paper, by means of a laser scanner and sensor. On that basis one may conclude that the dry line area on a pulp web of a breadth of e.g. 5 meters can be scanned and read to the sensor and further on to the computer at a resolution of 256×256 pixels, at intervals of less than 5 secs. Such an interval is sufficiently short for control of the paper machine on the basis of the continuously moving dry line, economizing on the use of the actuators.

The measured electrical signals which relate to the measured brightness and directional angles or their control voltages are transferred, transforming simultaneously the analog signals to digital data sequences, in real time to a computer, in which the determination of location of each dry line point takes place; the technology needed for these operations is generally known from the past. For detection of the secondary radiation emitted by objects of the laser radiation, one may also use a video camera which is provided, as may be needed, with optical filters and lens hoods, whose photoelectrical detector is preferably an integrated matrix of separate elements on which-the image of the dry line area is continuously formed. Both the location and brightness data on the object of radiation are hereby obtained through the camera, without a need of feedback information on the direction of the primary beam or on the quantities controlling this. It is hereby also useful to synchronize the speed of the continuous or stepwise scanning of the beam and the reading speed of the detector and possibly also the step length and laser beam diameter with each other in such a manner that the repeatedly determined dry line data can immediately be compared with each other.

The computer is programmed to also transform the image composed in the camera and in its direction, of the secondary radiation sources, or the corresponding sensor information obtained in the manner described previously, to location and brightness and, further on, to dry line data in the longitudinal and crosswise, rectangular coordinate system of the wire and, if needed, to transform said sensor information also to a coordinate system determined by the image formed e.g. by an obliquely targeted camera. On the basis of the dry line profile obtained which extends from one side of the wire to the other side, one may determine further on, as programmed, also the momentary average location of the dry line and, if needed, its mean deviation and other statistical, characteristic numbers, the gliding average location, momentary maximal and minimal readings etc. which are displayed for use of the machine operator, together with the graphic dry line curve and the corresponding, gliding average curve. The repeatedly renewed dry line data obtained can be used synchronously for launching of alarms, for feedback control of the dry line and for feedforward control of the paper machine, corresponding to the methods which have been used on the basis of dry line data determined by other practices; references are made to publications and patents stated earlier (J. Berndtson, A. J. Niemi & S. Karine, in Proceedings of $27^{th}$ Eucepa Conf., Grenoble, Oct. 11-14, 1999, ATIP, pp. 131-136 and A. J. Niemi & al. 2002).

The dry line used above as an example, which indicates the termination of the uniform, specularly reflecting water surface, lies usually in a region where transversal foils participate in the water removal, possibly assisted by a minute, separately produced vacuum. However, the pulp surface may elsewhere exhibit similar borderlines, which describe a change of reflectivity of the surface and which therefore may also be called dry lines. Such an other dry line is produced, as at a part of wire which is later than the dry line described previously, the free water left between the fibres or an essential part of it is removed by subjecting the pulp to powerful suction through the flat suction box or boxes located at the end part of the wire, whereby the scattering reflectance of the pulp surface is increased by this seater removal process at the same time as the remaining specular reflectivity of the surface is further decreased.—As a matter of fact, it is also possible to operate a paper machine in such a manner that the uniform, specularly reflecting surface extends down to the flat suction box, where both of the said dry lines are brought together by a powerful suction.

The description presented earlier (J. Berndtson & al. 1999 and some of its reference publications) relates to this other dry line appearing at the flat suction box, although not specifying this, and proves that it can be detected by means of the method according to the EP patent No 586458. On the basis of analogies, it is obvious that also this other dry line can be detected by the method according to the present invention. Said analogies mean here both the means of detection, i.e. the similar reflectivity of the radiation of a narrow and a wide spectrum, and the similarity of the processes, i.e. each dry line as an indicator of an increase of the scattering reflectance and as that of a decrease of the specular reflectance, with the difference that the new method gives prominence to the former one of the features stated last and the method according to the stated patent to the latter one of them.

A borderline which is comparable with the previous ones appears also in the region where the turbulent pulp transferred onto the wire from the head box is tranquilized to the specularly reflecting pulp stated previously. The scattering reflectivity of the turbulent pulp changes hereby to the specular reflectivity of the pulp's water surface or, in closer terms, the scattering reflectivity of the pulp surface is decreased and its specular reflectivity increased. The existence of this phenomenon is observable even by naked eye and for the whole breadth of the wire, i.a. from FIG. 6 of the publication stated previously (A. J. Niemi & S. Karine, 2002). Because this initial border of said water surface is connected to decrease of water in the pulp, it may also be called a dry line, although the change of reflectivity at it has an opposite direction to the change at the two dry lines stated previously. This third dry line can obviously be determined as a difference of the responses produced by laser beams, in the same manner as the dry lines stated above. The present invention relates accordingly to determination of all such borderlines which appear on the web surface, and which are related to change of reflectivity of the surface and which are directly or indirectly produced by change of amount of water, or by change of moisture, or by that of water proportion or by that of quality of the water/fibre suspension at the surface or in the surface layer of the web.

The devices for implementation of the presented method, especially the laser scanner and radiation detector being parts of the paper machine environment are small for their size and therefore easily installed in such a manner that they do not disturb the use or maintenance of the machine. The laser beam may scan the dry line area in a low angle from an arbitrary direction, wherefore a suitable direction is found easily. The same applies to the direction of observation, especially if a point-type detector is used. The direction of the optical observation may be even the same as that of the primary laser beam (FIG. 2), whereby the equipment causes practically no need of additional space, thus differing from the earlier equipments, which generally required a location of devices at both sides of the wire. The new method is able to determine the dry lines also on such ranges of the wire, which were not reached by the illumination or observation according to the earlier methods. It needs less of electrical and lighting energy than the earlier methods and produces a better signal/background ratio than they did.

The patents and reports (J. Berndtson & al. 1999, A. J. Niemi & al. 2002) stated earlier prove, that the earlier methods for dry line measurement apply to feedback control of the dry line. The new method can be applied, in a straightforward way, to tasks, which correspond to the control tasks described in them. The research results and the stated reports indicate additionally, that the dry lines located at different parts of the wire are in different manners correlated with other process variables, such as the slice opening of head box and the quality characteristics of final product. As a new feature, the latter report shows that the dry line indicating the termination of the specularly reflecting surface is correlated with the product's formation or with an index proportional to this. Especially at the making of a multi-ply product using head boxes of certain structures, it is therefore possible to use a method which, in addition to measurement of the formation utilizes also the dry line signal as another, measured quantity. The new method of measurement is therefore useful at the development of control methods which utilize these correlations, and which may be based e.g. on simultaneous determination of two different dry lines and on their use as input quantities of the control system in a paper machine.

A professional who is skilled in technology of papermaking may, on the basis of the invention presented, make conclusions on alternative methods, which are obvious in different paper machine environments. One such alternative is the use of laser radiation primarily on the basis of a change of the specularly reflecting component on pulp surface. It is possible e.g. to install, in the manner presented in the EP patent No 586458, at the side of the wire and parallelly to it, a vertical surface which diffuses light and to which the laser beam is directed. The light spot produced emits light to all directions, also onto the pulp surface. A camera, installed at the other side of the wire and viewing the wire in a low angle, observes in such a case the spot, if this is reflected to it by the specularly reflecting surface of the pulp, i.e. by that preceding the dry line, otherwise not, because a diffusively reflecting pulp surface does not transmit a sufficiently clear nor powerful image about the spot. If said vertical, light diffusing surface is scanned with a laser beam, the camera may thus form an image sequence, from which the dry line can be determined. Other, obvious alternatives are e.g. a simultaneous use of several, scanning laser beams and the spreading of the primary laser beam by a cylindrical lens to a plane surface, which produces onto the pulp surface a light streak which is perpendicular to direction of the scan, or by diffractive optics to a pyramidal or conical beam cluster, in order to speed up the image analysis. The methods indicated here and other methods corresponding to them are considered to be, on the basis of the invention, obvious to a professional and therefore to belong to the scope of the invention presented.

The invention claimed is:

1. A method for determining a dry line of a layer of material, and for control based on the dry line, in a Fourdrinier a paper machine, wherein said layer of material including the dry line which is to be monitored is continuously carried forward on a wire, the method comprising:

emitting laser radiation at one or more narrow frequency ranges;

illuminating various parts along the wire from a certain distance direction with respect to the surface of the layer of material on the wire in an area of appearance of the dry line by a beam cluster produced by said laser radiation;

optically observing an electromagnetic signal transmitted by the surface of said material by diffuse reflection of said beam cluster in a direction which differs from another direction of specular reflection related to an illumination direction;

repeatedly converting the observed optical signal representative of brightness level data to an electrical digital signal; and transmitting a location of the dry line on a basis of the brightness level data represented by said digital signal determined as indicative of a borderline between two parts of the surface having a changing value of said brightness level data.

2. A method according to claim 1, wherein the area of appearance of the dry line is scanned with said beam cluster produced by a source of laser radiation.

3. A method according to claim 2, wherein said control based on the dry line is carried out repeatedly, synchronously with scanning of the area of appearance of the dry line.

4. An apparatus for determining a dry line of a material, and for control based on the dry line, in a Fourdrinier paper machine, wherein said material including the dry line is carried forward on a wire, comprising:

a lighting source for illumination, in a chosen direction, of the material on the wire, said lighting source including a laser radiation source for repeated scanning of the area of appearance of the dry line appearing on the surface of pulp on the wire of the paper machine with a laser beam cluster;

a detector for observing an electromagnetic signal emanating, as effected by the illumination, from the material on the wire;

signal processing and control components for further processing of the measured signal produced by the detector and, on that basis, for controlling actuators of the paper machine;

components for determining, as an electrical signal, that part of the pulp surface which said beam cluster hits at a particular time corresponding thereto;

an optoelectrical detector operable for observing an electromagnetic signal and of converting said signal into an electrical digital signal, said optoelectrical detector being positioned so as to receive radiation produced by diffuse reflection of said beam cluster in a direction differing from that of specular reflection related to the direction of said illumination, said optoelectrical detector thus providing an electrical digital signal in response to the brightness level of said diffuse reflection;

components for converting said electrical signals to repeatedly renewed, digital signals and for transferring said digital signals and, for receiving and processing said digital signals; and a digital computer which is provided with programs for determining, on the basis of brightness level data transmitted by said digital signals, the dry line and quantities related to it and for outputting the dry line and signals and quantities related to it and for transferring these to alarm devices and to control devices and actuators of the paper machine.

5. In a Fourdrinier paper machine in which a layer of material including the dry line which is continuously carried forward on a wire, a method for monitoring and controlling the dry line comprising:

monitoring the dry line by use of a scanning laser beam;

differentiating between diffuse reflection of said scanning laser beam and specular reflection of said scanning laser beam related to a direction of illumination of a surface of the material thereby by measurement of a measured brightness level of reflected radiation in a given direction; and determining the dry line as a boundary between adjacent regions determined respectively as producing specular and diffuse reflection based upon said measured brightness level.

6. A method for monitoring a dry line of a layer of material in a Fourdrinier paper machine, and for control based upon said dry line, wherein said layer of material including the dry line which is to be monitored is continuously carried forward on a wire, the method comprising:

providing a source of laser radiation, said source emitting radiation at one or more narrow frequency ranges;

illuminating various parts of the wire, from a certain direction with respect to the surface of the layer of material on said wire, in the area of appearance of the dry line by means of a beam cluster produced by said source of laser radiation;

providing an optoelectrical detector capable of observing an electromagnetic signal and of converting said signal into an electrical digital signal;

arranging said optoelectrical detector to observe radiation produced by diffuse reflection of said beam cluster in a direction which differs from the direction of specular reflection related to the direction of said illumination, thus providing an electrical digital signal in response to the brightness level of said diffuse reflection, carrying out said illumination and observation in a region extending across said dry line; and determining the location of the dry line on the basis of said electrical digital signal, the brightness level and thus said signal changing essentially from one side to another of the dry line.

7. A method according to claim 6, wherein the area of appearance of the dry line is scanned with said beam cluster produced by said source of laser radiation.

8. An apparatus for monitoring the dry line in a Fourdrinier paper machine and for control based upon said dry line, comprising:

a source of laser radiation, said source emitting radiation at one or more narrow frequency ranges, said source of laser radiation being further arranged to provide a beam cluster illuminating various parts of the wire in the area of appearance of the dry line, and from a certain direction with respect to the surface of the layer of material on the wire;

an optoelectrical detector capable of observing an electromagnetic signal and of converting said signal into an electrical digital signal, said optoelectrical detector being positioned so as to receive radiation produced by diffuse reflection of said beam cluster in a direction differing from that of specular reflection related to the direction of said illumination, said optoelectrical detector thus providing an electrical digital signal in response to the brightness level of said diffuse reflection;

said source of laser radiation and said optoelectrical detector being arranged to carry out said illumination and observation in a region extending across said dry line; and a device for determining the location of the dry line on the basis of said electrical digital signal, the brightness level and thus said signal changing essentially from one side to another of the dry line.

* * * * *